United States Patent [19]

Gullichsen et al.

[11] Patent Number: 4,986,480

[45] Date of Patent: Jan. 22, 1991

[54] METHOD AND APPARATUS FOR FEEDING A CONICAL REFINER

[75] Inventors: Johan Gullichsen, Sjundea, Finland; Bengt Nilsson; Ronny Hoglund, both of Skoghall, Sweden

[73] Assignee: Kamyr AB, Karlstad, Sweden

[21] Appl. No.: 373,065

[22] Filed: Jun. 29, 1989

[51] Int. Cl.[5] ..... B02C 19/12

[52] U.S. Cl. ..... 241/28; 162/52; 241/37; 241/247; 241/259.2; 241/261.1

[58] Field of Search ..... 241/244, 245, 37, 246, 241/247, 261.1, 261.2, 261.3, 30, 28, 259.1, 259.2, 259.3; 162/52, 18

[56] References Cited

U.S. PATENT DOCUMENTS

| | | | |
|---|---|---|---|
| 2,573,321 | 10/1951 | Ernst . | |
| 3,327,952 | 6/1967 | Rosenfeld . | |
| 4,059,237 | 11/1977 | Mannstrom . | |
| 4,082,233 | 4/1978 | Reinhall | 241/247 X |
| 4,283,016 | 8/1981 | Reinhall | 241/247 X |
| 4,401,280 | 8/1983 | Reinhall . | |
| 4,457,804 | 7/1984 | Reinhall . | |
| 4,700,900 | 10/1987 | Rowland | 241/37 |
| 4,754,935 | 7/1988 | Gullichsen . | |
| 4,801,099 | 1/1989 | Reinhall | 241/259.2 X |

FOREIGN PATENT DOCUMENTS

| | | |
|---|---|---|
| 1079559 | 6/1980 | Canada . |
| 40371 | 11/1914 | Sweden . |

*Primary Examiner*—Mark Rosenbaum

*Attorney, Agent, or Firm*—Nixon & Vanderhye

[57] ABSTRACT

Mechanical cellulosic fibrous material pulp (mechanical pulp to produce paper products) having lower freeness, and enhanced light scattering properties, tensile and tear strengths, for a given energy input, is produced by force feeding a refiner. Using a progressive compacting plugscrew, cellulosic material (e.g. wood chips) is fed to the refiner inlet at a rate greater than the transporting capacity of the refiner (e.g. about 10–40% greater). The refiner preferably is a low frequency conical refiner with steam removal at the grinding area between the conical refiner elements. The production rate is regulated by sensing the axial force on the refiner rotor and controlling the spacing between the refiner elements in response to the sensed axial force. The screw has a compaction ratio of at least 3/1 for wood chips and 6/1 for pulp, and is rotated at about 6–10% the speed of rotation of the refiner rotor.

17 Claims, 2 Drawing Sheets

FIG. 2
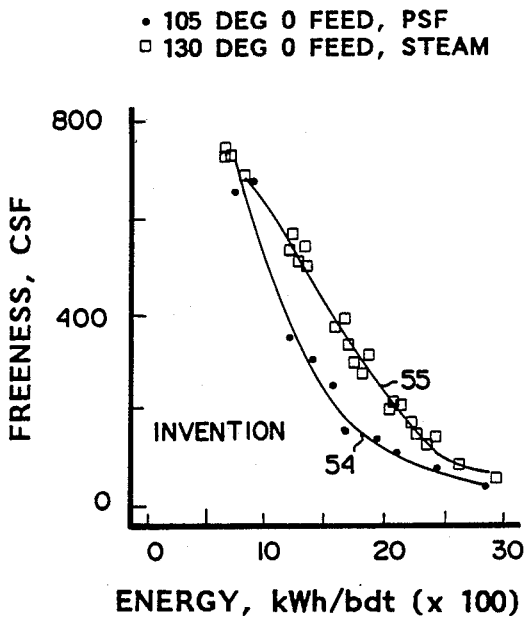
FIG. 3
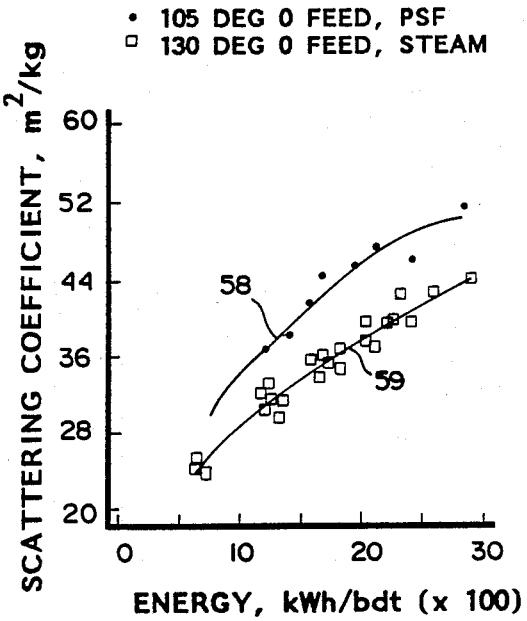
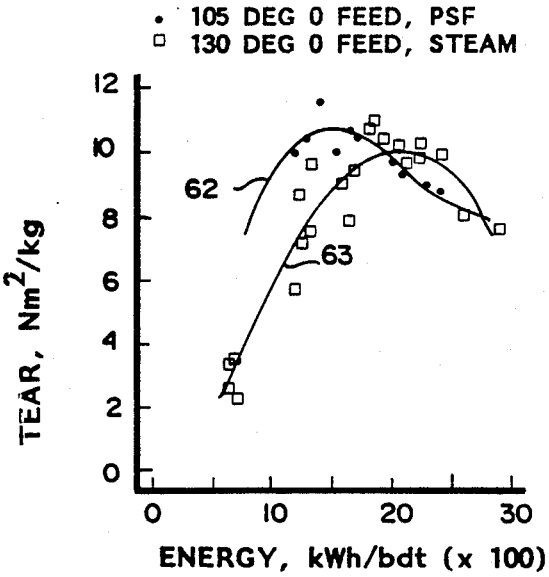
FIG. 4
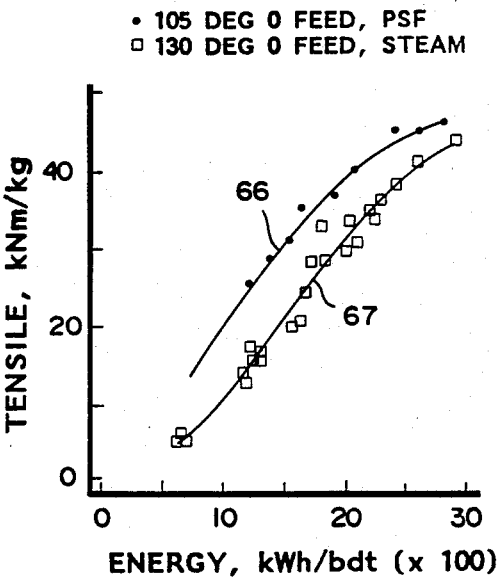
FIG. 5

METHOD AND APPARATUS FOR FEEDING A CONICAL REFINER

BACKGROUND AND SUMMARY OF THE INVENTION

In the production of mechanical pulps, including TMP, RMP, and CTMP, refiners having relatively rotatable refiner elements are fed with cellulosic fibrous material that is to be refined into mechanical pulp. Typically, the positive chip or pulp flow through the refiner is dependent upon the refiner's own transporting capability. A typical refiner has a considerably high transporting capability due to high centrifugal forces that are generated. The capacity of the refiner system is generally determined by the transporting capability of the refiner, and control of the flow of pulp and steam out of the refiner. Conventionally, refiners are fed utilizing with one or more standard screw conveyors having generally cylindrical shafts and flights in constant diameter conduits, such as shown in Canadian patent No. 1079559.

According to the present invention it has been found that when a refiner is force fed—rather than merely relying upon the refiner's own transporting capabilities—pulp having given freeness, tensile and tear strength, and light scattering abilities can be produced with less energy. Alternatively, using the same amount of energy as when one relies upon the refiner's own transporting capabilities, by force feeding the refiner one can obtain a more desirable pulp, i.e. one having lower freeness, greater light scattering coefficient, greater tensile strength, and greater tear strength (over a wide variety of energy values).

Force feeding of a refiner is preferably accomplished according to the invention by utilizing a progressive compacting plugscrew. Such a screw is a standard piece of equipment in the pulp and paper industry for transporting pulp or chips from atmospheric presteaming into a preheating conveyor which operates at a pressure comparable to that of a refiner, and in other situations where it is desirable to develop a plug of chips which substantially prevents the flow of steam, or other gases, therethrough, including with refiners (e.g. see U.S. Pat. Nos. 4,457,804 and 3,327,952). A plugscrew comprises a shaft having conically tapered flights, rotatable in a passageway that is conically tapered in sympathy with the conical tapering of the flights, so that as the cellulosic fibrous material is transported by the rotating screw air is expelled therefrom and it is compacted.

According to the method of the present invention, cellulosic fibrous material is refined to produce mechanical pulp using a mechanical refiner having a given transporting capacity. The method comprises the step of (a) force feeding the refiner (e.g. with a progressive compacting plugscrew) with cellulosic fibrous material at a rate greater than the transporting capacity of the refiner. It is desirable to feed the refiner with a feed screw that has a transporting capacity about 10–40% greater than that of the refiner itself. Preferably there also is provided the step of regulating production of pulp by sensing the axial force on the rotor shaft of the refiner and controlling the spacing between the refiner elements in response to the sensing. Screw compaction is achieved by both conicity of the screw and progression in the screw. The compaction ratio should be at least 3/1 for wood chips and 6/1 for pulp. The screw speed of rotation should be at least 1/100 of the refiner rpm (e.g. about 6–10%).

The benefits achieved according to the invention are enhanced when the refiner that is utilized is a conical refiner, particularly a low frequency conical refiner such as shown in U.S. Pat. No. 4,754,935 and co-pending U.S. application Ser. No. 07/070,212, filed July 6, 1987 as a continuation of Ser. No.07/008,667 filed Jan. 30, 1987, now abandoned. Such a refiner has steam removal means within an actual grinding area between the refiner elements, and a centrifugal separator associated with the rotor shaft for centrifugally separating steam and fibers, and allows for effective, low energy production of mechanical pulp. When the force feeding according to the present invention is properly practiced so that a plug of chips (cellulosic fibrous material) forms that prevents passage of steam out of the refiner inlet, the pulp produced will have a lower freeness, greater light scattering coefficient, greater tensile strength, and—over a wide variety of energy levels—greater tear strength, than pulp produced without force feeding of the refiner, for a given amount of energy.

According to another aspect of the present invention, a mechanical cellulosic fibrous material pulp having good freeness, light scattering, tensile strength, and tear properties is produced for a given energy input, utilizing a mechanical refiner. The pulp is produced by the step of force feeding the refiner with cellulosic fibrous material at a rate about 10–40% greater than the transporting capacity of the refiner.

According to another aspect of the present invention, there is provided an apparatus for producing pulp from cellulosic fibrous material. The apparatus comprises: (a) A mechanical refiner having at least two relatively movable refining elements, and a rotor shaft connected to one of the elements, a material inlet, and a pulp outlet, and a given transporting capacity. And, (b), means for force feeding the refiner inlet with material at a rate greater than the transporting capacity of the refiner. The means (b) preferably comprises a progressive compacting plugscrew. The refiner (a) preferably is a conical refiner with means for adjusting the spacing between the refining elements, steam removal means, and a centrifugal separator—e.g. a low frequency refiner. Means are provided for sensing the axial force on the rotor shaft and in response to the sensed force actuating the means for adjusting the spacing between the conical refining elements to control production.

It is the primary object of the present invention to provide for the production of mechanical pulp that has enhanced properties, at a given energy input level, by force feeding a refiner. This and other objects of the invention will become clear from an inspection of the detailed description of the invention, and from the appended claims.

BRIEF DESCRIPTION OF THE DRAWINGS

FIG. 2 is a graphical representation of the plot of energy versus freeness comparing pulp produced according to the invention with pulp produced utilizing no force feeding of the refiner; and FIGS. 3 through 5 are graphical representations of the energy versus scattering co-efficient, tear, and tensile strength, respectively, comparing production of pulp according to the invention with like pulp produced without force feeding the refiner.

DETAILED DESCRIPTION OF THE DRAWINGS

Figure 1:
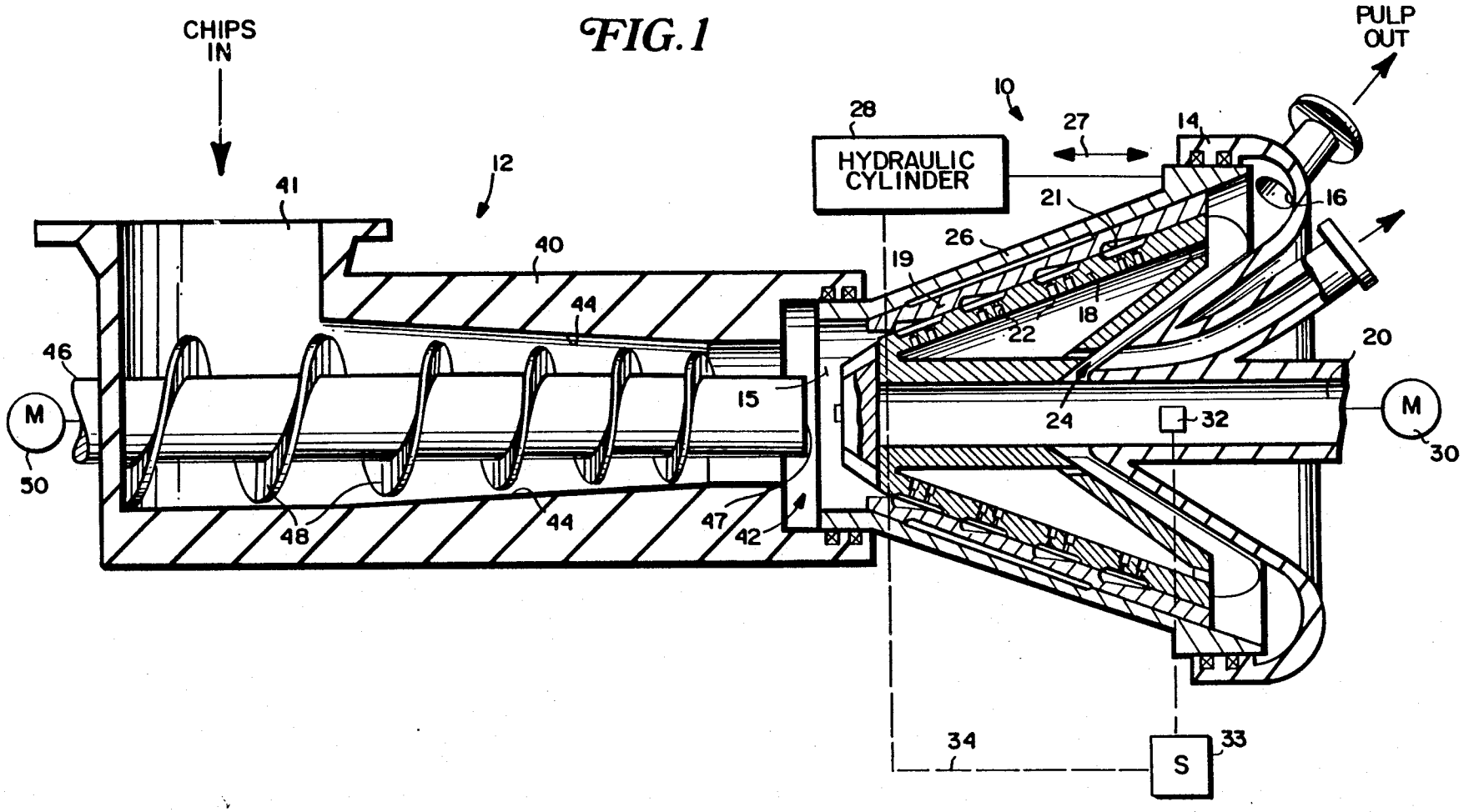
FIG. 1 is a side view, partly in cross-section and partly in elevation, of an exemplary apparatus according to the present invention.

The exemplary apparatus according to the present invention illustrated in FIG. 1 comprises a mechanical refiner 10 and a feeding means 12 for feeding cellulosic fibrous material (e.g. wood chips) to the refiner 10. The refiner has grinding surfaces on relatively rotatable grinding elements that are used to reduce the wood chips to mechanical pulp, and preferably is a low frequency conical refiner such as shown in U.S. Pat. No. 4,754,935 (the disclosure of which is hereby incorporated by reference herein).

The refiner 10 includes a casing 14 having a chips inlet 15 and a pulp outlet 16. In the specific embodiment illustrated the conical refining element 18 is rotatable with respect to the stationary conical refining element 19, the element 18 being connected to a rotatable shaft 20. However both elements 18, 19 may be rotated, or the outer element may be rotated while the inner element is stationary, or more than two grinding elements may be provided. A grinding zone 21 is established between the elements 18, 19, and means are provided —such as passageways 22—for the removal of steam directly from the grinding zone 21. A centrifugal separator 24 is also preferably provided, all as described in said U.S. Pat. No. 4,754,935.

Means are also provided for adjusting the spacing between the elements 18, 19. This is preferably accomplished by mounting the outer casing element 26 so that it is reciprocal in the dimension of arrows 27 by a hydraulic cylinder 28 or the like to move the position of the element 19 with respect to the rotating element 18. The shaft 20 is rotated by a conventional motor 30. In order to control production, it is desirable to provide a conventional sensor 32 for sensing the axial force on the shaft 20, and to feed that sensed information to a controller 33 which then controls the cylinder 28 to adjust the spacing between the elements 18, 19 to control the production.

According to the present invention, the wood chips are force fed to the axially central inlet 15 of the refiner 10. This is accomplished by utilizing the conventional plugscrew illustrated as the element 12 in FIG. 1. This progressive compacting plugscrew comprises a housing 40 having a material inlet 41 and an outlet 42, the outlet 42 being directly in line with and in communication with the chips inlet 15 to the refiner 10. The housing 40 is configured so that there is a surface 44 which is conical and tapers generally from the inlet 41 to the outlet 42, decreasing in diameter as it moves from the inlet to the outlet. Inlet 41 is typically connected to a presteaming vessel. Mounted for rotation within the housing 40 by conventional bearings or the like is a rotatable shaft 46 having flights 48 thereon. The flights are configured so that they have a constantly decreasing height as they move helically from the inlet 41 toward the outlet 42, the constantly decreasing height conforming to the conical taper of the surface 44. At the end of the shaft 47 at the outlet 42 no flights are provided, and at that area a plug of chips is formed by the compressing action of the flights 48 rotating within the volume defined by the surface 44, so that steam and gases cannot easily—if at all—pass through the chips plug out of the chips inlet 15 to the refiner 10. The shaft 46 is rotated by a conventional motor 50 (e.g. a 50 cycle d.c. motor).

The compacting feed screw 12 should have a transporting capacity about 10–40% above that of the refiner 10 (calculated as centrifugal force minus friction losses for a given rotor-stator gap setting). The screw should have a turning speed at least 1/100 of the refiner rpm, e.g. about 6–10%. For example, if the refiner rotor 18 turns at 1500 rpm, the speed screw speed is most desirably about 100–150 rpm. The relative direction of rotation of the shafts 46 and 20 are not important (they can be the same or opposite). It is important that a suitably steam tight plug is formed by the screw 12. This means the screw compaction ratio should be at least 3/1 for wood chips, and at least 6/1 for pulp. Screw compaction is obtained both by conicity of the screw, and progression in the screw. For example a 3/1 conicity and 2/1 screw progressivity yield a 6/1 screw compaction.

For good plug formation it is also important to have a "blank" section-length at the end 47 of the screw equal to the smallest diameter of the conical surface 44, as is illustrated in FIG. 1.

Alternatively, the feeding means 12 may be an inclined screw which forms a chips plug.

Utilizing the apparatus of FIG. 1 pulp may be produced having enhanced properties for a given energy input. FIGS. 2 through 5 indicate the plots of a number of different desirable pulp properties versus energy input, FIG. 2 plotting freeness versus energy input, FIG. 3 light scattering coefficient, FIG. 4 tear strength, and FIG. 5 tensile strength. In each case, pulp was produced according to the invention utilizing apparatus such as illustrated in FIG. 1, and then utilizing the same low frequency refiner only feeding it in a non-forcing manner using a conventional screw conveyor having constant height flights rotating in a constant diameter tube, and the same raw material (wood chips). When the non-compacting conventional screw conveyor was utilized, a pressure in the steaming vessel for the chips (connected to the inlet to the screw conveyor) was 0.5 bar higher than in the refiner. Refining was done at 2.5 bar over pressure. Utilizing the apparatus according to the invention, as illustrated in FIG. 1, a steaming vessel pressure was 2.0 bars below the refining pressure. The refining frequency for all test runs, both utilizing the compacting screw according to the invention or the conventional non-compacting screw, was 600 Hz at the rotor (1200 Hz at the stator), and the operating pulp consistency was identical.

In FIG. 2, the plot of pulp produced according to the invention is illustrated by curve 54, while that utilizing the conventional feeding to the low frequency refiner is illustrated by 55. In FIG. 3 the pulp according to the invention is indicated by curve 58, the conventionally produced pulp 59. In FIG. 4 the pulp according to the invention is illustrated by curve 62, while conventionally produced pulp is illustrated by curve 63. In FIG. 5 pulp produced according to the invention is illustrated by curve 66 while the conventionally produced pulp is illustrated by curve 67.

As an inspection of the graphs makes clear, pulp produced according to the invention—for any given energy input—had a lower freeness, higher light scattering coefficient, and greater tensile strength than pulp produced conventionally. Also, the tear strength is higher over the majority of range of energy input. Thus it will be seen that according to the present invention not only is it possible to produce pulp having better properties at a given energy input, it is possible to produce pulp having the same properties as conventional mechanical pulp with a lower energy input.

While the invention has been described specifically with respect to a low frequency refiner, such as illustrated in U.S. Pat. No. 4,754,935, the invention is not restricted thereto. The invention is applicable to conventional refiners, although an enhanced effect is recognized when the compacting screw is utilized with a low frequency refiner.

It will thus be seen that according to the present invention it is possible to produce mechanical pulp having better properties at a given energy level, or the same properties at a lower energy input, as conventionally produced pulp by utilizing a simple process change, with apparatus that is commercially available. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods, apparatus, and products.

What is claimed is:

1. Apparatus for producing pulp from cellulosic fibrous material comprising:

(a) a mechanical refiner having at least two relatively movable refining elements, and a rotor shaft connected to one of said elements, a material inlet, and a pulp outlet, and a given transporting capacity; and (b) means for force feeding said refiner inlet with material at a rate greater than the transporting capacity of said refiner, and forming a plug of material at the refiner inlet which substantially prevents passage of steam therethrough, said force feeding means comprising a progressive compacting plug screw having a blank portion on the screw at the most narrow portion of the surrounding housing, immediately adjacent the refiner.

2. Apparatus as recited in claim 1 wherein said progressive compacting plugscrew has a compaction of at least 6/1 for pulp and at least 3/1 for wood chips.

3. Apparatus as recited in claim 2 further comprising a first motor for rotating the refiner rotor shaft, and a second motor for rotating the screw at about 6–10% the speed of rotation of the refiner rotor shaft.

4. Apparatus as recited in claim 2 wherein said refiner is a conical refiner, said refining elements being conical and extending outwardly and away from said inlet, said inlet being centrally located at the axis of said shaft.

5. Apparatus as recited in claim 4 further comprising (c) means for adjusting the spacing between said refining elements, (d) means for sensing the axial force on said rotor shaft, and (e) means for controlling (c) in response to the sensed force utilizing (d).

6. Apparatus as recited in claim 4 wherein (a) is a low frequency refiner with steam removal means within an actual grinding area between said refiner elements.

7. Apparatus as recited in claim 6 wherein (a) includes a centrifugal separator associated with said rotor for centrifugally separating steam and fibers.

8. Apparatus as recited in claim 1 further comprising (c) means for adjusting the spacing between said refining elements, (d) means for sensing the axial force on said rotor shaft, and (e) means for controlling (c) in response to the sensed force utilizing (d).

9. Apparatus as recited in claim 1 wherein said refiner is a conical refiner, said refining elements being conical and extending outwardly and away from said inlet, said inlet being centrally located at the axis of said shaft.

10. Apparatus as recited in claim 1 wherein (a) is a low frequency refiner with steam removal means within an actual grinding area between said refiner elements.

11. Apparatus as recited in claim 2 wherein said progressive compacting plug screw includes a screw within a surrounding housing defining a central opening tapered to a most narrow point, with a screw within said opening.

12. A method of refining cellulosic fibrous material to produce mechanical pulp, using a mechanical refiner having an inlet and a given transporting capacity, comprising the step of:

(a) force feeding the refiner with cellulosic fibrous material at a rate greater than the transporting capacity of the refiner, including by feeding the material into the inlet with a progressive compacting screw so that passage of steam out of the refiner through the inlet is substantially prevented.

13. A method as recited in claim 12 wherein the refiner has a rotor shaft and at least two refiner elements, one of which is connected to the rotor shaft, and comprising the further step of:

(b) regulating production of mechanical pulp by sensing the axial force on the rotor shaft and controlling the spacing between the refiner elements in response to this sensing.

14. A method as recited in claim 12 wherein step (a) is practiced so that the rate of feed compared to transporting capacity of the refiner so that for a given amount of energy, the pulp produced will have a lower freeness, greater light scattering coefficient, and greater tensile strength than pulp produced without force feeding of the refiner.

15. A method as recited in claim 12 wherein step (a) is practiced by feeding the refiner at a rate about 10–40% greater than the transporting capacity of the refiner.

16. A method as recited in claim 15 wherein the refiner has a rotor, and is fed by a screw which is rotated at about 6–10% the speed of rotation of the refiner rotor.

17. A method as recited in claim 12 wherein step (a) is practiced using a screw having a compaction ratio of at least 3/1 for wood chips, and at least 6/1 for pulp.

* * * * *